US005158198A

United States Patent [19]

Melideo

[11] Patent Number: 5,158,198

[45] Date of Patent: Oct. 27, 1992

[54] DUMPSTER BIN WITH ARTICULATED FOLDING TOP CLOSURE

[76] Inventor: Michael Melideo, 600 W. 9th St., #1501, Los Angeles, Calif. 90015

[21] Appl. No.: 700,229

[22] Filed: May 14, 1991

[51] Int. Cl.[5] ..... B65D 43/26

[52] U.S. Cl. ..... 220/263; 220/332; 220/331; 220/333; 220/908

[58] Field of Search ..... 220/908, 255, 331, 332, 220/333, 264, 263, 211; 296/101; 414/407, 408; 160/188, 213

[56] References Cited

U.S. PATENT DOCUMENTS

| | | | |
|---|---|---|---|
| 1,788,036 | 1/1931 | Straubel | 220/225 |
| 3,270,902 | 9/1966 | Breault | 220/908 X |
| 3,833,255 | 9/1974 | Logue | 296/101 |
| 4,213,539 | 7/1980 | Reuter | 220/333 |
| 4,489,810 | 12/1984 | Curits | 220/263 X |
| 4,518,095 | 5/1985 | Engwert | 220/260 |
| 4,585,266 | 4/1986 | Steinberg | 220/333 X |
| 4,625,888 | 12/1986 | Thompson | 220/263 X |
| 4,655,004 | 4/1987 | Caillet | 160/188 X |
| 4,853,985 | 8/1989 | Perry | 220/333 X |
| 5,011,214 | 4/1991 | Friesen et al. | 220/334 X |

*Primary Examiner*—Stephen Marcus
*Assistant Examiner*—Paul A. Schwarz
*Attorney, Agent, or Firm*—John J. Posta, Jr.

[57] ABSTRACT

A dumpster bin for use in collecting and storing refuse is disclosed which has first and second folding top cover doors which may be operated in a manner allowing the top of the dumpster bin to be fully opened. The first and second top cover doors are hingedly connected together, with the first top cover door also being hingedly attached at the side thereof to the top of the dumpster bin at one side thereof. A hand winch is used to actuate a pivot arm assembly mounted on the end of the first top cover door, with the pivot arm opening the first top cover door, which in turn draws the second top cover door up close to it, thereby fully opening the top of the dumpster bin.

4 Claims, 8 Drawing Sheets

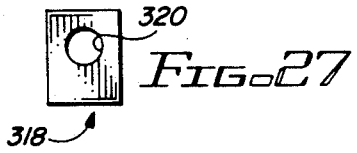
FIG. 27
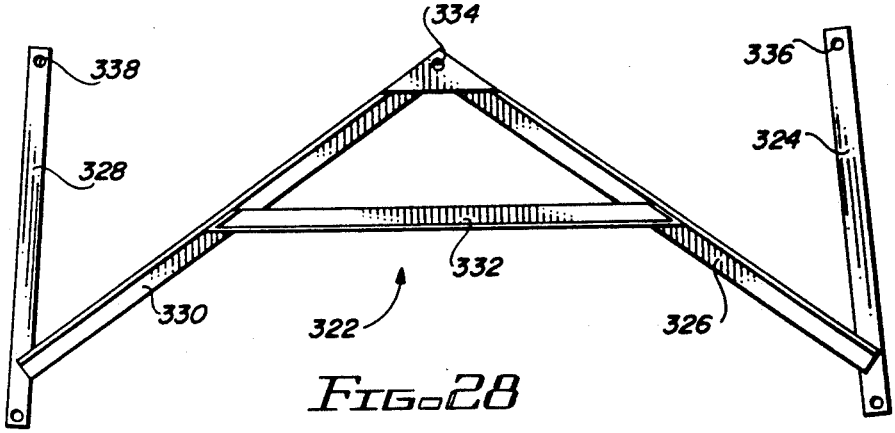
FIG. 28
FIG. 26
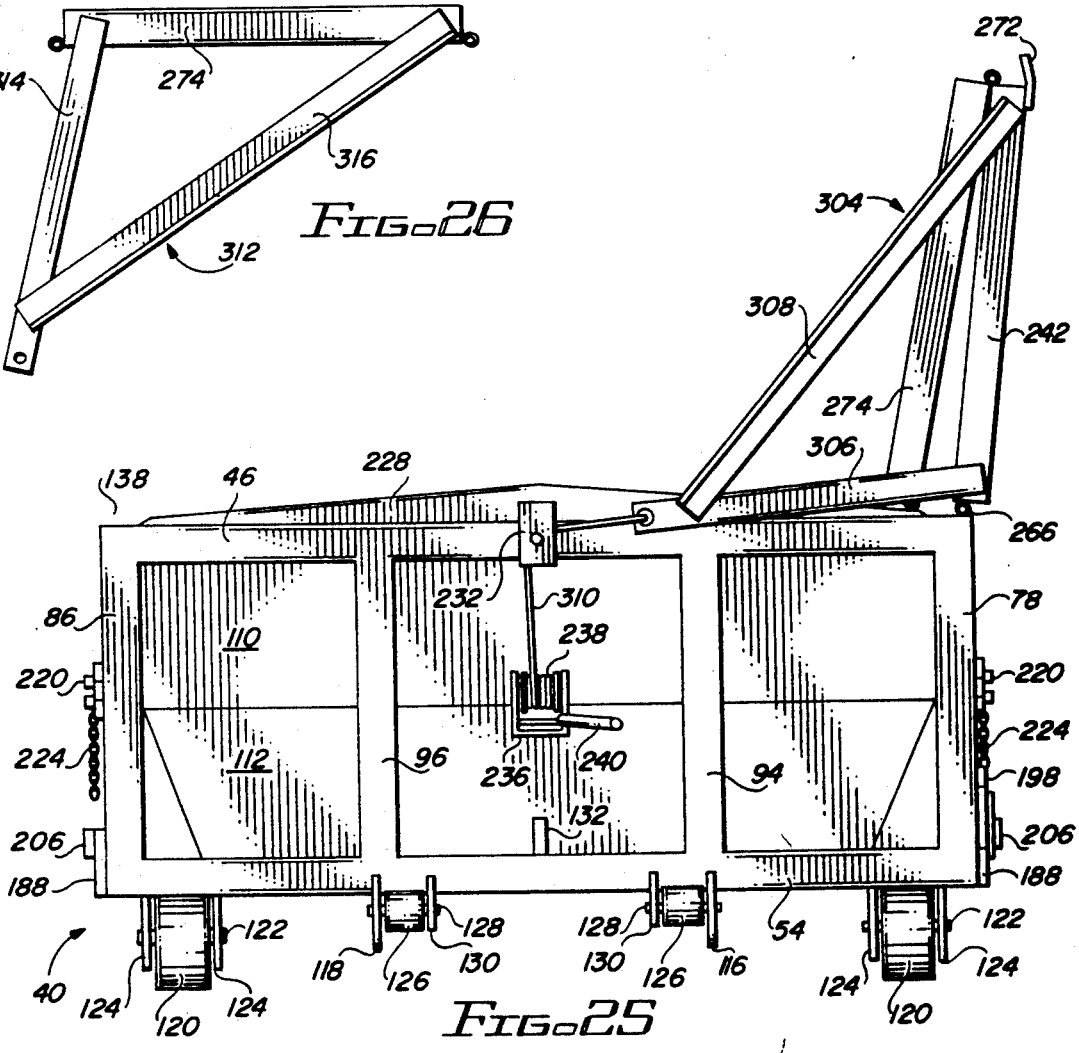
FIG. 25

DUMPSTER BIN WITH ARTICULATED FOLDING TOP CLOSURE

BACKGROUND OF THE INVENTION

1. Field of the Invention

The present invention relates generally to a dumpster bin for collecting refuse, and more particularly to a dumpster bin having double folding top cover doors which may be operated in a manner allowing the top of the dumpster bin to be fully opened.

The predominant method of short-term collection and storage of refuse for commercial and industrial sites, and indeed in most locations other than residences, is in dumpster bins. These dumpster bins are typically located in an outdoor storage area, with refuse being dumped into the dumpster bins over a relatively short period of time such as several days or a week. The dumpster bins vary in size somewhat, with the smallest dumpster bin typically holding well over 100 cubic feet of refuse.

The dumpster bins typically have at least a simple cover to prevent them from collecting water in the event of rain or snow. In addition, although the dumpster bins are fairly large and heavy, they typically have wheels to enable them to be maneuvered from a storage location into position for loading either onto a truck or a fork lift. Dumpster bins are also generally of both heavy-duty and simple construction to make them both durable and relatively inexpensive.

There are two basic types of dumpster bins in widespread use at the present time. A first type of dumpster bin is designed for permanent placement at a single location, with the dumpster bin being emptied into a collection truck at its location when it is full. This type of dumpster bin is typically designed with slots for receiving forks used to lift the dumpster bin up and empty it into the collection truck. The dumpster bin is then lowered back to the ground and replaced in its storage location, where it may be refilled.

A second type of dumpster bin is designed for placement at a commercial or industrial location only until it is filled. When the dumpster bin is filled, a specially designed collection truck comes to the location of the dumpster bin. This specially designed truck has a hydraulically operated rear bed consisting of a pair of spaced-apart rails pivotally mounted at a point nearer the back ends of the rails than their front ends. The front ends of the twin rails are hydraulically raised, which brings the back ends of the twin rails downward to the ground.

The dumpster bin is then brought to the back of the collection truck. The dumpster bin is specially configured to allow it to ride up on the pair of twin rails onto the collection truck. Accordingly, the dumpster bin is aligned with the pair of twin rails, and a cable is used to pull the dumpster bin up onto the twin rails. When the dumpster bin is pulled fully up onto the twin rails, the twin rails may be hydraulically lowered onto the truck bed, and the truck may then take the dumpster bin to a landfill or other disposal site, where it may be emptied.

Dumpster bins typically have one or two top cover doors which are used to close the top of the dumpster bins. The door(s) on top of a dumpster bin are opened to allow refuse to be placed in the dumpster bin. The use of door(s) on the top of a dumpster bin serve two primary purposes: they keep refuse stored in the dumpster bin inside the dumpster bin, and to at least some extent they enclose the interior of the dumpster bin to protect it from weather.

The function of keeping refuse inside a dumpster bin is particularly important for the second type of dumpster bin described above. If a dumpster bin is loaded onto the back of a collection truck and taken to a site for refuse disposal, the top of the dumpster must be securely enclosed to prevent refuse from spilling out of the top of the dumpster during transport to the disposal site. Thus, it will be appreciated that the top cover(s) must be sufficiently secure to prevent refuse spillage during transport.

While a single hinged steel top is used on small dumpster bins, larger bins must necessarily use a different top construction, because a single steel top cover would be far too heavy for an individual to operate without assistance. Thus, many dumpster bins use double hinged steel top cover doors. If the top cover doors are hinged in the middle of the dumpster bin, the entire top of the dumpster bin may not be opened. This is a significant disadvantage because it limits the size of refuse which may be placed in the dumpster bin.

If the top cover doors are hinged to open onto the sides of the dumpster bin, the dumpster bin must be located in an open area in order to open both top side doors. Thus, if the dumpster bin is located with its side against a wall, it must first be moved away from the wall in order to allow both of the top side doors to be opened. This is disadvantageous, and represents a significant limitation on the utility of such a dumpster bin.

Other top closure techniques used on larger dumpster bins in the past to overcome the limitations imposed by large steel doors include the use of multi-sectional steel rolling doors, fiberglass lids, or tarpaulins to enclose the top of a dumpster bin. Of these closures, the rolling steel doors are technically the best since they are the most secure. However, rolling steel doors are an extremely expensive alternative, and are considerably less durable than a hinged steel top cover. In addition, rolling steel doors may require an excessive amount of maintenance due to their construction and the number of parts involved.

One or two fiberglass doors on a dumpster bin are lightweight and easy to operate, but far less durable than steel doors. In addition, if two fiberglass doors are used, the same disadvantages described above for steel top cover doors are present. Finally, tarpaulins are at best only a partial solution. The time necessary to secure and remove a tarpaulin is significant, and tarpaulins are not nearly as convenient to use as a hinged top cover door. Additionally, tarpaulins are just not very durable, particularly as compared to steel top cover doors.

Several other disadvantages are also present in presently known dumpster bin designs. For example, most presently available dumpster bins are not highly water resistant. The cover(s) located on the top side of dumpster bins are particularly to blame for this problem. A single piece top cover door is more water resistant, but is too heavy to be easily opened on all but the smallest dumpster bins. Double top cover doors are easier to use, but are less water resistant than a single top cover door. In addition, double top cover doors are generally not sealable other than by their own weight. Finally, it may also be desirable to allow a dumpster bin to be emptied without completely inverting it.

It is accordingly the primary objective of the present invention that it provide a highly secure, yet easily operated means for covering the top of a dumpster bin in a manner allowing the entire top of the dumpster bin to be opened. It is a further objective that the operation of the top to open or close a dumpster bin must be quick, convenient, and easily performed by a single individual. Further, opening the top of a dumpster bin must be accomplished without requiring that a dumpster bin located with its side against the side of a building be moved prior to opening the top of the dumpster bin.

It is a further objective of the present invention to provide a double top cover door design possessing all of the advantages listed above which will be suitable for use with larger dumpster bins. It is an additional objective of the present invention that the top closure include a securing mechanism to maintain refuse in the dumpster bin both during storage and during transport to a refuse disposal site. The securing means must also be easy and quick to operate, and it must be operable by a single individual. In a further objective, it is desirable to provide a water resistant design to the top of the dumpster bin. It is also an objective that the top cover mechanism of the present invention allow the use of a rear side door through which the contents of the dumpster bin may be removed, if desired.

It is a concurrent objective of the present invention that the dumpster bin top cover doors and operating mechanism which embody the principles of the present invention be of a construction not substantially more expensive than steel top cover doors of presently available dumpster bins. In addition, the dumpster bin top cover doors of the present invention must be at least as durable and long lasting as the top cover doors of such presently available dumpster bins. Finally, it is also an objective that all of the aforesaid advantages and objectives of the present invention be achieved without incurring any substantial relative disadvantage.

SUMMARY OF THE INVENTION

The disadvantages and limitations of the background art discussed above are overcome by the present invention. With this invention, first and second folding top cover doors are used to cover the open top of a dumpster bin. Each of the top cover doors thus is used to cover one-half of the opening in the top of the dumpster bin. The top cover doors are joined together with a hinge mechanism located at the adjacent edges of the top cover doors when they are in a closed position covering the top of the dumpster bin.

The edge of the first top cover door opposite the hinge mechanism attaching it to the second top cover door is hingedly attached to the top edge of the dumpster bin on a first side thereof. The hinge mechanism used to attach the first top cover door to the dumpster bin is preferably of the type having hinge tubes located on both the first top cover door and the top edge of the first side of the dumpster bin, with the hinge tubes on the two members being interdigitated and retained together by a hinge pin extending therethrough. In the preferred embodiment, there are at least two sets of hinges used to connect the first top cover door to the dumpster bin.

Thus, it will be appreciated that the first top cover door is hingedly connected to the first side of the dumpster bin on one side of the first top cover door, and to the second top cover door on the other side thereof. When the top cover doors are in the closed position, the side of the second top cover door is located on the top edge of the dumpster bin on a second side thereof which is opposite the first side of the dumpster bin. A securing mechanism is used to retain the second top cover door (and thus both top cover doors) in this position.

In the preferred embodiment, the securing mechanism used is similar to the hinge mechanism used to hingedly attach the first top cover door to the first side of the dumpster bin. (In an alternate embodiment version of the invention to be discussed later, the securing mechanism will be necessarily identical to the hinge mechanism to allow the top cover doors to be opened from either side of the dumpster bin.)

Thus, in the preferred embodiment, hinge tubes are located on both the second top cover door and the top edge of the second side of the dumpster bin, with these hinge tubes becoming interdigitated when the top cover doors are in their closed position on the dumpster bin. These interdigitated hinge tubes may be retained together by inserting a hinge pin therethrough. In the preferred embodiment, there are at least two sets of securing mechanisms used to releasably fasten the second top cover door to the dumpster bin.

In the preferred embodiment, sloped ridge caps are mounted on third and fourth sides of the dumpster bin (the sides of the dumpster bins extending between the first and second sides of the dumpster bin). The top cover doors will rest on these ridge caps when they are in their closed position, thereby having a pitch to drain water off of the top cover doors. In addition, one of the top cover doors also has an angled ridge cover mounted thereon which will overly the joint between the top cover doors when they are in their closed position to provide further protection against water entering the dumpster bin.

Located on one the third side of the dumpster bin is a hand cranked winch, and a pulley assembly. A pivot arm assembly is mounted at two locations on the side of the first top cover door adjacent the third side of the dumpster bin. An end of the pivot arm assembly located away from the first top cover door is attached to a cable, which extends through the pulley assembly and is wound onto the hand cranked winch. As the winch is cranked, the first top cover door is opened, with movement of the first top cover door being hinged movement about the hinge mechanisms located between the first top cover door and the first side of the dumpster bin.

As the first top cover door opens, it will draw with it the second top cover door. The edge of the second top cover door which was adjacent the second side of the dumpster bin will slide on the ridge caps (using small rollers in the preferred embodiment). The hand winch is used to cause the pivot arm assembly to move the first top cover door through approximately ninety degrees of movement, at which time it will be fully open. At this time, the second top cover door will move to a position close to the first top cover door. The top of the dumpster bin will be completely open and accessible from three sides.

It will of course be appreciated that the first top cover door could be hingedly connected to the second side of the dumpster bin, with the first top cover door being free. In this case a pivot arm assembly which is the mirror image of the pivot arm assembly used on the first top cover door will be used on the second top cover door. The operation of the device is the same, with both top cover doors being drawn to a position above the second side of the dumpster bin.

In an alternate embodiment, a dual pivot arm assembly is used, which is essentially both of the two above pivot arms in a single unit. The dual pivot arm assembly is permanently attached to the hinge between the first and second top cover doors. The other point of attachment is to either the first top cover door or the second top cover door, via a removeable connection. In this embodiment, the securing mechanism is identical to the hinge mechanism described above. Thus either the first top cover door or the second top cover door may be used as the pivot point, with the other side being used as the securing side.

It may therefore be seen that the present invention teaches a highly secure, yet easily operated dumpster bin top cover apparatus which allows the entire top of the dumpster bin to be opened. The operation of the mechanism to open or close the doors of a dumpster bin is quick and convenient, and may be easily performed by a single individual. Further, opening the top of a dumpster bin does not require that a dumpster bin located with its side against the side of a building be moved prior to opening the top of the dumpster bin.

The double top cover door design of the present invention possesses all of the advantages listed above, and is eminently suitable for use with larger dumpster bins. The top cover doors of the present invention include a securing mechanism which maintains refuse in the dumpster bin, both during storage and during transport to a refuse disposal site. The securing means requires only the insertion of a pair of pins, and is thus easy and quick to perform, and of course may be accomplished by a single individual. A water resistant design is utilized in the top cover doors of the dumpster bin. The top cover mechanism of the present invention allows the use of a rear side door through which the contents of the dumpster bin may be removed, if desired.

The dumpster bin top cover doors and operating mechanism which embody the preceding principles of the present invention are of a construction not significantly more expensive than steel top cover doors of previously available dumpster bins. In addition, the dumpster bin top cover doors of the present invention are every bit as durable and long lasting as the top cover doors of such presently available dumpster bins Finally, all of the aforesaid advantages and objectives of the present invention are achieved without incurring any substantial relative disadvantage.

DESCRIPTION OF THE DRAWINGS

These and other advantages of the present invention are best understood with reference to the drawings, in which:

FIG. 25 is a front side view of the dumpster bin shown in FIG. 23 and 24, with the mechanism shown in a position in which the top cover doors are in their fully opened position;

FIG. 26 is a plan view of an alternate pivot arm assembly which may be installed on the first top cover door instead of on the second top cover door as shown in FIGS. 23 through 25;

FIG. 27 is a plan view of a bracket for installation at the front outside corners of the first and second top cover doors for use with an alternate embodiment dual pivot arm assembly;

FIG. 28 is an alternate embodiment dual pivot arm assembly for use with the bracket shown in FIG. 27.

DETAILED DESCRIPTION OF THE PREFERRED EMBODIMENT

Figure 1:
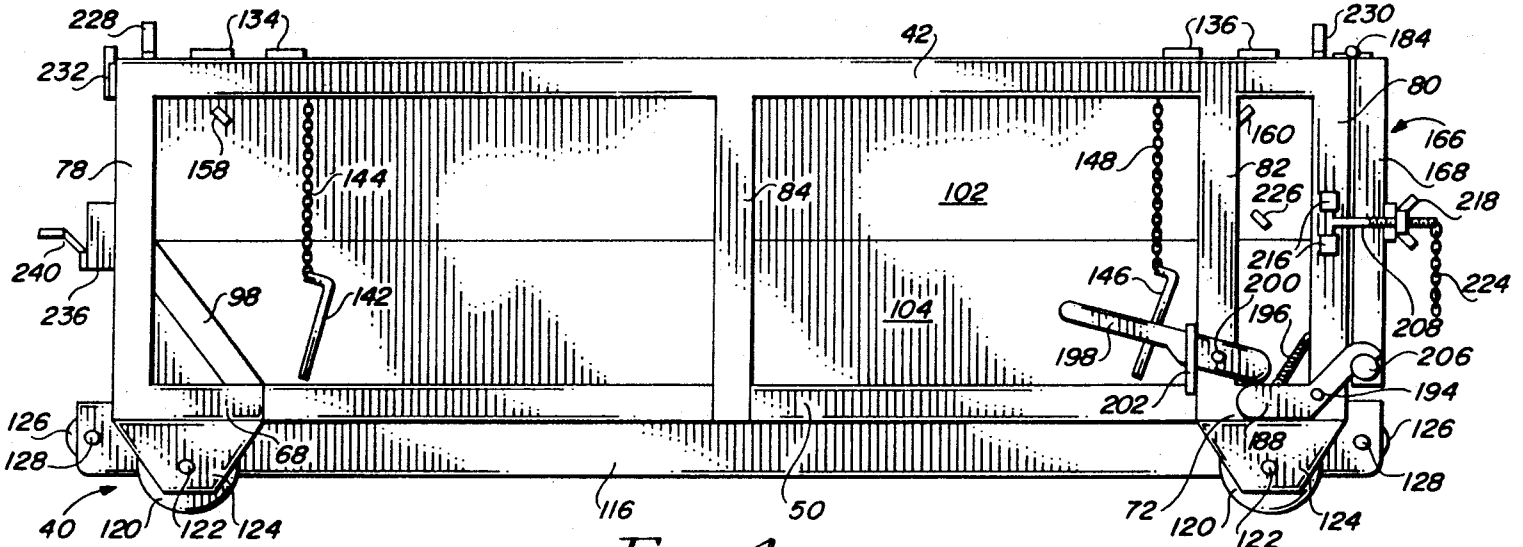
FIG. 1 is a left side view of a dumpster bin for use with the top cover doors and top cover door operating mechanism of the present invention, with top cover doors and a pivot arm assembly removed for clarity, showing the placement of two pairs of hinge tubes on top of the left side of the dumpster bin, and the location of the ridge caps on top of the front and rear sides of the dumpster bin.

The preferred embodiment of the dumpster bin of the present invention uses a basic construction which is similar to the construction of conventional dumpster bins. This construction style is using a frame made of rectangular or square tubular steel members, with the enclosure being defined by steel plate walls located generally inside the frame. It will be recognized that this construction is relatively simple, yet strong and durable. Accordingly, the dumpster bin of the present invention retains this advantageous construction while embellishing it with improvements.

Referring generally to FIGS. 1 through 6, a dumpster bin 40 is illustrated with the top cover doors and the pivoting mechanism for opening the top cover doors removed to facilitate the description of the dumpster bin 40. It should be noted that the construction of the dumpster bin 40 could differ significantly from that shown without departing from the principles of the present invention. Thus, the construction of the dumpster bin 40 should be viewed as exemplary in nature.

The dumpster bin 40 includes a number of welded together frame members, in the preferred embodiment all of which are made of steel tubes which are either square or rectangular in cross-section. In describing the construction and operation of the dumpster bin 40, the side illustrated in FIG. 1 will be described as the left side, the side illustrated in FIG. 2 will be described as the right side, the side illustrated in FIG. 3 will be described as the front side, the side illustrated in FIG. 4 will be described as the rear side, the side illustrated in FIG. 5 will be described as the top side, and the side illustrated in FIG. 6 will be described as the bottom side. These terms are a convenience used for the description herein, and in no way are intended to limit the construction of the dumpster bin 40.

The frame members of the dumpster bin 40 may be separated into three groups: horizontal top frame members, horizontal bottom frame members, and vertical side frame members. The top frame members include a top left frame member 42, a top right frame member 44, a top front frame member 46, and a top rear frame member 48 (shown only in FIG. 5).

The bottom frame members (shown best in FIG. 6) include two main frame members oriented between the front and rear sides of the dumpster bin 40, seven members oriented between the left and right sides of the dumpster bin 40, and five smaller frame members also oriented between the front and rear sides of the dumpster bin 40. The two bottom main frame members oriented between the front and rear sides of the dumpster bin 40 are a bottom left frame member 50 and a bottom right frame member 52; both of these members extend from the front to the rear of the dumpster bin 40, and are spaced inwardly from the left and right sides of the dumpster bin 40.

Of the seven bottom main frame members oriented between the left and right sides of the dumpster bin 40, five extend all the way between the left and right sides of the dumpster bin 40. A bottom front frame member 54 is located at the front of the dumpster bin 40, and a bottom rear frame member 56 is located at the rear of the dumpster bin 40. A bottom frame member 58 is located spaced slightly behind the bottom front frame member 54, and a bottom frame member 60 is located spaced slightly in front of the bottom rear frame member 56. A bottom frame member 62 is located intermediate the bottom frame members 58 and 60.

Two other bottom main frame members extend between the bottom left frame member 50 and the bottom right frame member 52. A bottom frame member 64 is located intermediate the bottom frame members 58 and 62. A bottom frame member 66 is located intermediate the bottom frame members 60 and 62.

There are five smaller frame members located on the bottom of the dumpster bin 40. A short bottom frame member 68 extends between the bottom front frame member 54 and the bottom frame member 58 at their ends on the left side of the dumpster bin 40. A short bottom frame member 70 extends between the bottom front frame member 54 and the bottom frame member 58 at their ends on the right side of the dumpster bin 40.

A short bottom frame member 72 extends between the bottom rear frame member 56 and the bottom frame member 60 at their ends on the left side of the dumpster bin 40. A short bottom frame member 77 extends between the bottom rear frame member 56 and the bottom frame member 60 at their ends on the right side of the dumpster bin 40. Finally, a short bottom frame member 76 extends between the middles of the bottom front frame member 54 and the bottom frame member 58.

Figure 2:
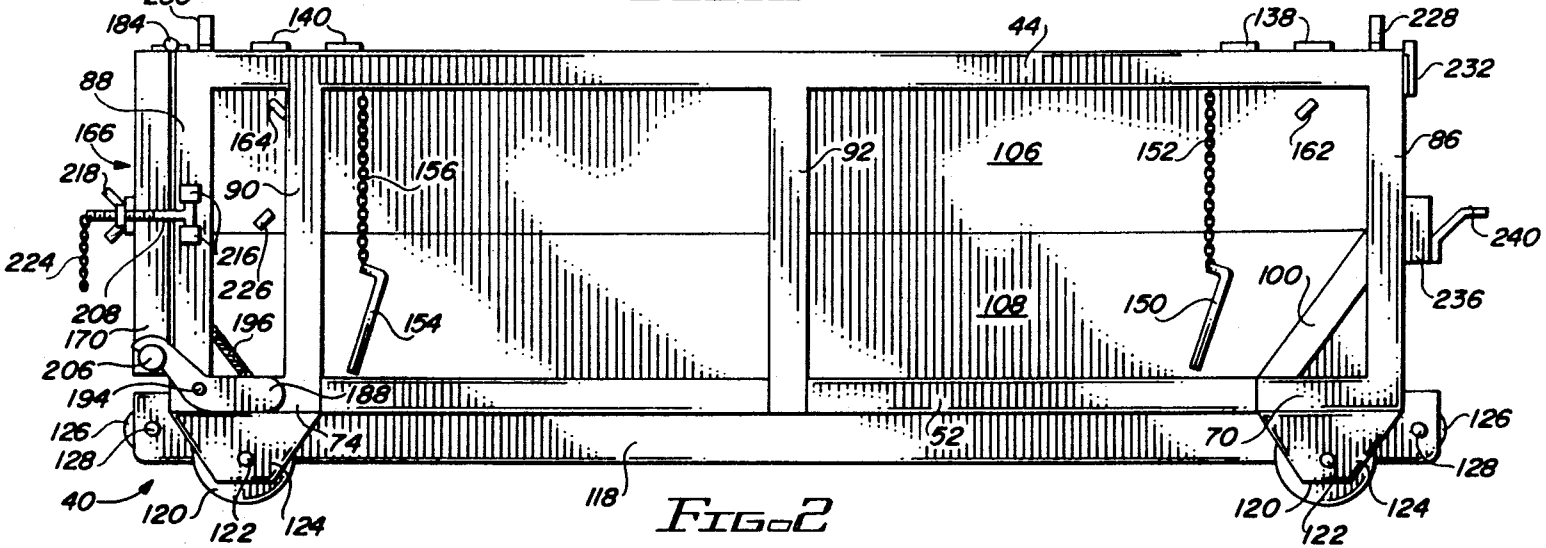
FIG. 2 is a right side view of the dumpster bin shown in FIG. 1, showing the placement of two pairs of hinge tubes on top of the right side of the dumpster bin, and the location of the ridge caps on top of the front and rear sides of the dumpster bin.
Figure 3:
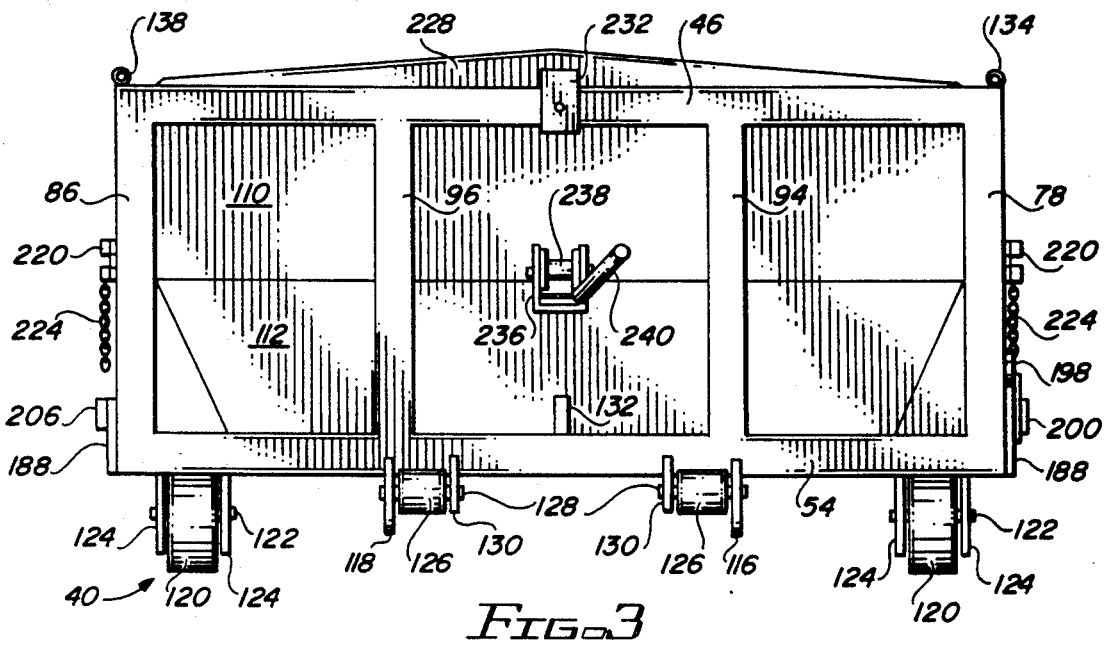
FIG. 3 is a front side view of the dumpster bin shown in FIGS. 1 and 2, showing a hand cranked winch and a pulley assembly which will be used to operate the top cover doors (not shown) of the present invention, and the configuration of the ridge cap located on top of the front side of the dumpster bin.

The side main frame members are best shown in FIGS. 1 through 3, although all of FIGS. 1 through 6 are helpful in their description. Referring first particularly to FIG. 1, four vertical main frame members are located on the left side of the dumpster bin 40. A left front frame member 78 is located at the front of the dumpster bin 40, and extends between the top left frame member 42 and the intersection of the bottom front frame member 54 and the short bottom frame member 68. A left rear frame member 80 is located at the rear of the dumpster bin 40, and extends between the top left frame member 42 and the intersection of the bottom rear frame member 56 and the short bottom frame member 72.

A left frame member 82 is located spaced slightly ahead of the left rear frame member 80, and extends between the top left frame member 42 and the intersection of the bottom frame member 60 and the short bottom frame member 72. A left frame member 84 is located intermediate the left front frame member 78 and the left frame member 82, and extends between the top left frame member 42 and the bottom frame member 62.

Referring now particularly to FIG. 2, four vertical main frame members are located on the right side of the dumpster bin 40. A right front frame member 86 is located at the front of the dumpster bin 40, and extends between the top right frame member 44 and the intersection of the bottom front frame member 54 and the short bottom frame member 70. A right rear frame member 88 is located at the rear of the dumpster bin 40, and extends between the top right frame member 44 and the intersection of the bottom rear frame member 56 and the short bottom frame member 74.

A right frame member 90 is located spaced slightly ahead of the right rear frame member 88, and extends between the top right frame member 44 and the intersection of the bottom frame member 60 and the short bottom frame member 74. A right frame member 92 is located intermediate the right front frame member 86 and the right frame member 90, and extends between the top right frame member 44 and the bottom frame member 62.

Referring now particularly to FIG. 3, two additional vertical main frame members are located on the front side of the dumpster bin 40. A front frame member 94 is located closer to the left front frame member 78 than to the right front frame member 86, and extends between the top front frame member 46 and the bottom front frame member 54. A front frame member 96 is located closer to the right front frame member 86 than to the left front frame member 78, and extends between the top front frame member 46 and the bottom front frame member 54.

Two additional frame members which function as braces are located on the left and right sides of the dumpster bin 40. As shown in FIG. 1, a brace member 98 extends between the middle of the left front frame member 78 and the intersection of the bottom frame member 58 and the short bottom frame member 68. Referring then to FIG. 2, a brace member 100 extends between the middle of the right front frame member 86 and the intersection of the bottom frame member 58 and the short bottom frame member 70. This concludes the basic frame of the dumpster bin 40, which is typically assembled by welding. It will be noted that the top and the rear of the dumpster bin 40 are open and unobstructed by frame members.

Four of the six sides of the dumpster bin 40 have one or more steel side plates installed on the inside of the frame. Typically, of course, these side plates, since they are on the inside of the frame, will be installed prior to final assembly of the frame. The side plates are also installed by welding them to the various frame members. Note that the left, right, and front sides of the dumpster bin 40 each have upper and lower side plates, with the lower side plates extending inwardly to form a "hopper" configuration.

Referring first to FIG. 1, a top left side plate 102 is installed inside the frame in the area bounded by the top left frame member 42, and the top halves of the left front frame member 78, the left rear frame member 80, and the left frame members 82 and 84 A bottom left side plate 104 is installed inside the frame in the area bounded by the bottom of the top left side plate 102 and the bottom left frame member 50.

Referring now to FIG. 2, a top right side plate 106 is installed inside the frame in the area bounded by the top right frame member 44, and the top halves of the right front frame member 86, the right rear frame member 88, and the right frame members 90 and 92. A bottom right side plate 108 is installed inside the frame in the area bounded by the bottom of the top right side plate 106 and the bottom right frame member 52.

Referring next to FIG. 3, a top front side plate 110 is installed inside the frame in the area bounded by the top front frame member 46, and the top halves of the left front frame member 78, the right front frame member 86, and the front frame members 94 and 96. A bottom front side plate 112 is installed inside the frame in the area bounded by the bottom of the top front side plate 110 and the bottom frame member 58.

Figure 6:
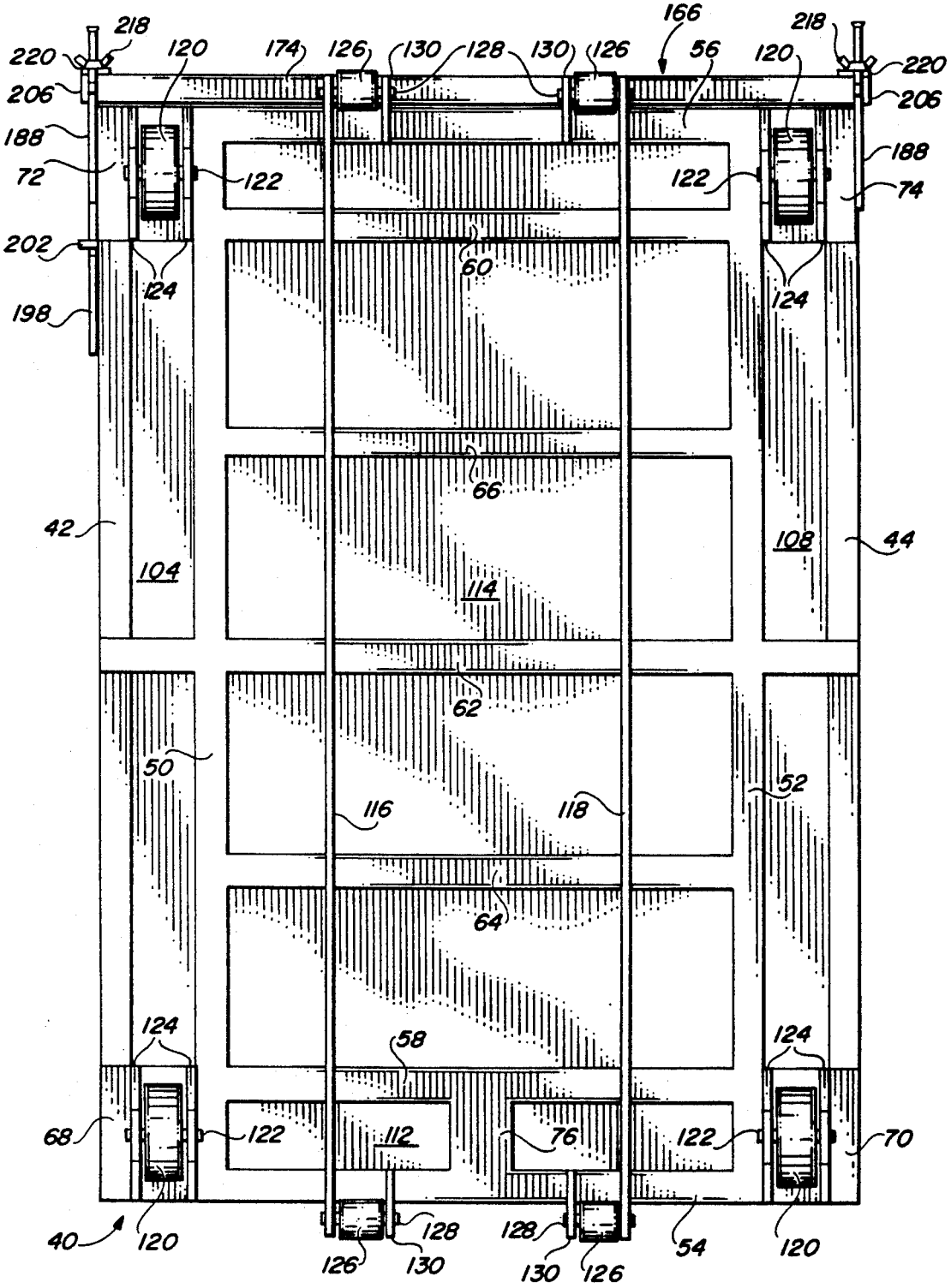
FIG. 6 is a bottom view of the dumpster bin shown in FIGS. 1 through 5.

Referring finally to FIG. 6, a bottom plate 114 is installed to form a floor inside the frame in the area bounded by the bottom left frame member 50, the bottom right frame member 52, the bottom frame member 58, and the bottom rear frame member 56. This completes construction of the interior walls of the dumpster bin 40.

Referring now generally to FIGS. 1 through 6 again, the dumpster bin 40 is designed to be loaded onto a twin rail collection truck. Accordingly, the dumpster bin 40 has a left alignment plate 116 which extends from the front to the rear of the dumpster bin 40, and is located some distance to the left of the centerline of the dumpster bin 40. A right alignment plate 118 extends from the front to the rear of the dumpster bin 40, and is located an equal distance to the right of the centerline of the dumpster bin 40.

The total distance between the alignment plates 116 and 118 is dictated by the width of the twin rails in a refuse collection truck, which is standard. The left alignment plate 116 will fit just to the left (outside) of the leftmost of the twin rails on the truck, and the right alignment plate 118 will fit just to the right (also outside) of the rightmost of the twin rails on the truck. The left alignment plates 116 and 118 may be made of plate stock, and are securely welded onto the various frame members described above.

Also located on the bottom of the dumpster bin 40 are four wheels 120, which allow the dumpster bin 40 to be maneuvered on the ground. Each of the four wheels 120 is mounted on an axle 122 suspended between a pair of bracket members 124. The axis of each of the axles 122 is fixed. Referring to FIG. 6, a bracket member 124 welded onto the bottom left frame member 50 near the front end thereof and a bracket member 124 welded onto the short bottom frame member 68 together support a axle 122 and a wheel 120 at the left front corner of the dumpster bin 40. A bracket member 124 welded onto the bottom left frame member 50 near the rear end thereof and a bracket member 124 welded onto the short bottom frame member 72 together support an axle 122 and a wheel 120 at the left rear corner of the dumpster bin 40.

A bracket member 124 welded onto the bottom right frame member 52 near the front end thereof and a bracket member 124 welded onto the short bottom frame member 70 together support an axle 122 and a wheel 120 at the right front corner of the dumpster bin 40. A bracket member 124 welded onto the bottom right frame member 52 near the rear end thereof and a bracket member 124 welded onto the short bottom frame member 74 together support an axle 122 and a wheel 120 at the right rear corner of the dumpster bin 40.

Note that although fixed wheels 120 are used on the dumpster bin 40 shown herein, either the wheels located at the front of the dumpster bin 40 or the wheels located at the rear of the dumpster bin 40 (or both) could be mounted on brackets which allow them to swivel to allow the dumpster bin 40 to be maneuvered more easily.

Also located on the bottom of the dumpster bin 40 are four nose rollers 126, which allow the dumpster bin 40 to easily move onto and off or the twin rails of the collection truck (not shown). Each of the nose rollers 126 is mounted on an axle 128 suspended between one of the alignment plates 116 or 118 and a nose roller bracket member 130. The axis of each of the axles 128 is fixed. Referring to FIG. 6, the front edge of two of the nose rollers 126 are located slightly forward of the bottom front frame member 54, and the rear edge of the other two nose rollers 126 are located slightly to the rear of the bottom rear frame member 56.

Two nose rollers 126 are thus mounted under the bottom front frame member 54 between the alignment plates 116 and 118, with one adjacent the left alignment plate 116 and the other adjacent the right alignment plate 118. The other two nose rollers 126 are mounted under the bottom rear frame member 56 between the alignment plates 116 and 118, with one adjacent the left alignment plate 116 and the other adjacent the right alignment plate 118. The nose rollers 126 are spaced apart to allow them to fit a standard twin rail collection truck (not shown).

Figure 18:
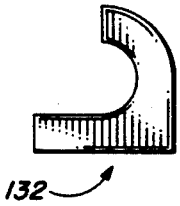
FIG. 18 is a side plan view of a hook which may be used to pull the dumpster bin of FIGS. 1 through 6 onto a collection truck.

Referring again to FIG. 18 a hook 132 is shown which is welded onto the top of the bottom front frame member 54, as shown in FIG. 3. The hook 132 is used to pull the dumpster bin 40 onto a twin rail collection truck (not shown). As shown in FIG. 6, the short bottom frame member 76 extending between the bottom front frame member 54 and the bottom frame member 58 helps distribute the forces exerted by the hook 132 on the frame of the dumpster bin 40.

Referring now to FIGS. 1 through 5, a plurality of the hinge tubes located on top of the left and right sides of the dumpster bin 40 are illustrated. Each pair of the hinge tubes shall be given a different reference numeral, although it will be understood by those skilled in the art that they are all identical. The hinge tubes are elements of a hinge assembly in which two sets of hinge tubes will be assembled together in interdigitated fashion with a hinge pin. The hinge assemblies may be used either as hinges, or as securing mechanisms.

A pair of hinge tubes 134 is located near the front of the top left frame member 42 adjacent the outside edges of the top left frame member 42. The pair of hinge tubes 134 are coaxial, spaced apart, and in a longitudinal orientation with respect to the top left frame member 42. A pair of hinge tubes 136 is located near the rear of the top left frame member 42. The pair of hinge tubes 136 are also coaxial, spaced apart, and in a longitudinal orientation with respect to the top left frame member 42.

A pair of hinge tubes 138 is located near the front of the top right frame member 44 adjacent the outside edges of the top left frame member 42. The pair of hinge tubes 138 are coaxial, spaced apart, and in a longitudinal orientation with respect to the top right frame member 44. A pair of hinge tubes 140 is located near the rear of the top right frame member 44 adjacent the outside edges of the top left frame member 42. The pair of hinge tubes 140 are also coaxial, spaced apart, and in a longitudinal orientation with respect to the top right frame member 44.

Figure 7:
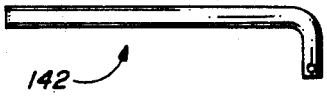
FIG. 7 is a plan view of one of the hinge pins which will be placed in the hinge tubes shown in Figs. 1 through 5.

Referring now particularly to FIGS. 1 and 2, a hinge pin 142 (made of cylindrical stock, as shown in FIG. 7) is mounted at one of a chain 144, the other end of which is attached to the top left frame member 42 under the location of the pair of hinge tubes 134. A hinge pin 146 is mounted at one of a chain 148, the other end of which is attached to the top left frame member 42 under the location of the pair of hinge tubes 136. A hinge pin 150 is mounted at one of a chain 152, the other end of which is attached to the top right frame member 44 under the location of the pair of hinge tubes 138. A hinge pin 154 is mounted at one of a chain 156, the other end of which is attached to the top right frame member 44 under the location of the pair of hinge tubes 140.

A hook 158 is welded onto the outside of the top left side plate 102 just under the location of the pair of hinge tubes 134. A hook 160 is welded onto the left frame member 82 just under the location of the pair of hinge tubes 136. A hook 162 is welded onto the outside of the top right side plate 106 just under the location of the pair of hinge tubes 138. A hook 164 is welded onto the right frame member 90 just under the location of the pair of hinge tubes 140.

The hooks 158, 160, 162, and 164 are used to retain the hinge pins 142, 146, 150, and 154, respectively, in the pairs of hinge tubes 134, 136, 138, and 140, respectively, once they are so inserted. By way of example, the hinge pin 142 is first inserted into the pair of hinge tubes 134. The loose portion of the chain 144 is then hooked onto the hook 158. The hinge pin 142 will thus effectively be prevented from being removed from the pair of hinge tubes 134 until the chain 144 is first removed from the hook 158.

Figure 4:
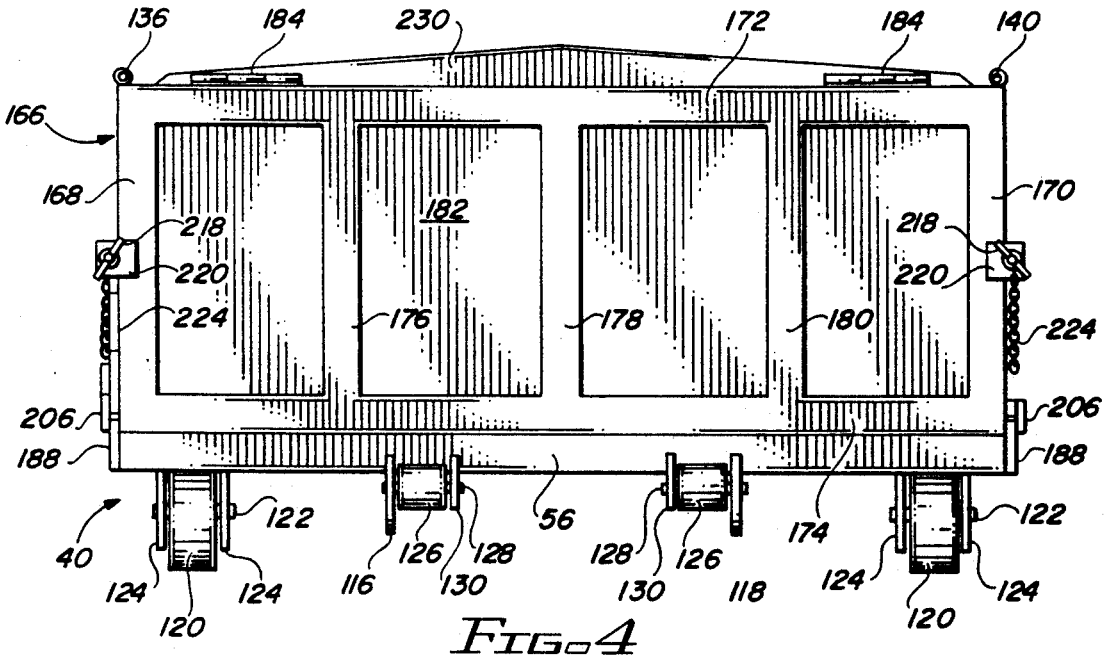
FIG. 4 is a rear side view of the dumpster bin shown in FIGS. 1 through 3, showing the configuration of the ridge cap located on top of the rear side of the dumpster bin, and the rear side door.

Referring now to FIG. 4, a rear side door 166 used on the dumpster bin 40 is shown which has a frame construction much the same as the front side of the dumpster bin 40. The edges of the rear side door 166 are defined by a left door frame member 168, a right door frame member 170, a top door frame member 172, and a bottom door frame member 174. Three additional vertical frame members 176, 178, and 180 are utilized. The three frame members 176, 178, and 180 all extend between the top door frame member 172 and the bottom door frame member !74. The three frame members 176, 178, and 180 are evenly and consecutively spaced at locations between the left door frame member 168 and the right door frame member 170.

A rear side plate 182 is installed (preferably by welding) inside the door frame in the area bounded by the left door frame member 168, the right door frame member 170, the top door frame member 172, and the bottom door frame member 174. The rear side door 166 is supported by a pair of hinges 184 of conventional construction, appropriate portions 172 and the top rear frame member 48.

Figure 14:
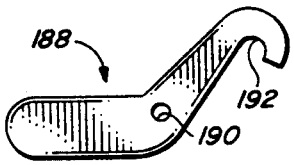
FIG. 14 is a plan view of one of the latch bars used to latch the rear side door in a closed position.

The rear side door 166 is held in place by a latching mechanism, as well as by a locking mechanism. The latching mechanism uses a pair of pivotally mounted latch bars 188, one of which is shown in Fig. 14. The latch bar 188 is roughly S-shaped, and preferably has rounded ends. It also has an aperture 190 located near the middle thereof, and an angled notch 192 located in one end thereof. The angled notch 192 is angled upward and toward the one end, as shown in the figure.

Referring now to Figs. 1, 2, and 6, the latch bars 188 are mounted on the ends of a rod 194 (by welding them to the ends of the rod 194) which rod 194 extends from one side of the dumpster bin 40 to the other through apertures (not shown) located at the bottom and rear of the sides of the frame structure. The latch bars 188 are located in aligned fashion, and pivot together.

Springs 196 are attached to the ends of the latch bars 188 opposite the location of the angled notches 192. The opposite end of one of the springs 196 is attached to the left rear frame member 80, and the opposite end of the other of the springs 196 is attached to the right rear frame member 88. The springs 196 urge the ends of the latch bars 188 having the angled notches 192 therein downwardly.

Located on the left side of the dumpster bin 40 is a pivotally mounted latch operation bar 198. The pivot point of the latch operation bar 198 is at a pin 200. The end of the latch operation bar 198 closer to the pivot point engages the end of the latch bar 188 on the left side of the dumpster bin 40 which end is opposite the angled notch 192. The other end of the latch operation bar 198 may be pulled upwardly to cause the end of the latch bars 188 having the angled notches 192 therein to move upwardly. Movement of the latch operation bar 198 is limited by a bracket 202.

Figure 15:
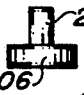
FIG. 15 is a top view of the latching post used on the sides of the rear side door at the bottom thereof, which latching posts are engaged by the latch bars of FIG. 14.

The other component used in the rear door latching mechanism is illustrated in FIG. 15. A cylindrical latching post 204 for engaging the angled notch 192 in the latch bars 188 has a length at least slightly longer than the thickness of the latch bars 188. A cap 206 of a larger diameter than the latching post 204 is welded onto one end of the latching post 204. The other end of the latching post 204 is for attachment by welding onto one of the sides of the rear side door 166. As shown in Figs. 1 and 2, the latching posts 204 are mounted at the bottom of the left door frame member 168 and the right door frame member 170 (although the caps 206 obscure the actual view of the latching posts 204).

In operation, the springs 196 normally maintain the latch bars 188 in the positions shown in FIGS. 1 and 2. To unlatch the rear side door !66, the end of the latch operation bar 198 nearest the front end of the dumpster bin 40 is pulled upward, moving the ends of the latch bars 188 having the angled notches 192 therein upwardly, releasing the latching posts 204. When the latch operation bar 198 is released, the latch bars 188 move back to the positions shown. As the rear side door 166 is closed, the latching posts 204 engage the latch bars 188, moving them upwardly to allow the latching posts 204 to move into the angled notches 192 in the latch bars 188, which then retain the rear side door 166 in the closed position.

Figure 8:
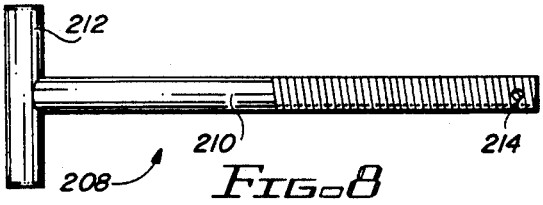
FIG. 8 is a plan view of a T-shaped member used in the locking mechanism used to lock the rear side door of the dumpster bin shown in FIG. 4 in its closed position.

The locking mechanism used to lock the rear side door 166 in the closed position is illustrated in FIGS. 8 through 13. Referring first to FIG. 8, a T-shaped member 208 is illustrated which consists of a long cylindrical rod 210 welded orthogonally to the midpoint of a short cylindrical rod 212. The end of the long cylindrical rod 210 not connected to the short cylindrical rod 212 is threaded. In addition, an aperture 214 is located in the threaded end of the long cylindrical rod 210.

Figure 9:
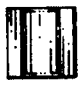
FIG. 9 is a plan view of one of the U-shaped retaining members used to rotatably retain the T-shaped member of Fig. 8.
Figure 10:
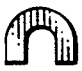
FIG. 10 is a top view of the U-shaped retaining member shown in FIG. 9.
Figure 11:
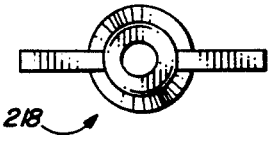
FIG. 11 is a plan view of one of the wingnuts used on the T-shaped member shown in FIG. 8.
Figure 12:
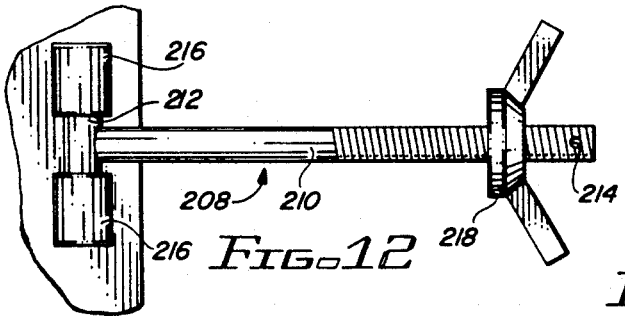
FIG. 12 shows the T-shaped member of FIG. 8 installed using two of the U-shaped retaining members of FIGS. 9 and 10, with one of the wingnuts of FIG. 11 installed on the T-shaped member.

Referring next to FIGS. 9 and 10, a U-shaped retaining member 216 is illustrated. FIG. 11 shows a wingnut 218, which is threaded onto the threaded end of the long cylindrical rod 210 of the T-shaped member 208, as shown in FIG. 12. The U-shaped retaining members 216 are welded to the frame of the dumpster bin 40 (the left rear frame member 80 in Fig. 1, with an additional assembly to the right rear frame member 88 as shown in FIG. 2). It will be appreciated that the T-shaped members 208 can pivot in the U-shaped retaining members 216.

Figure 13:
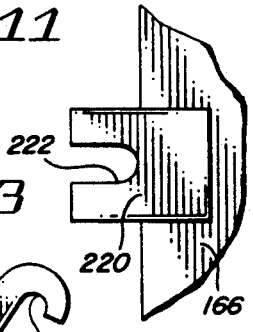
FIG. 13 is a plan view of one of the lock plates installed on the sides of the rear side door shown in FIG. 4, showing the notch in the lock plate.
Figure 20:
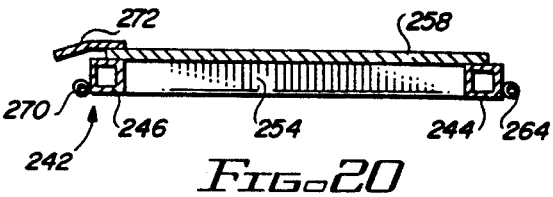
FIG. 20 is a cross-sectional view of the first cover door shown in FIG. 19.

Referring now to FIG. 13, a lock plate 220 is shown welded onto the frame of the rear side door 166 (the left door frame member 168 in FIG. 20, but also to the right door frame member 170 as shown in FIG. 4). The lock plate 220 has a U-shaped notch 222 in the outside edge thereof for receiving the long cylindrical rod 210 of the T-shaped member 208.

Referring now to FIGS. 1, 2, and 4, when the rear side door 166 is in the closed position the long cylindrical rods 210 of the T-shaped members 208 may be placed into the U-shaped notches 222 of the lock plates 220. The wingnuts 218 may then be screwed tight to lock the rear side door 166 in the closed position. Note that the chains 224 are attached to the long cylindrical rods 210 of the T-shaped members 208 via the apertures 214. There are a pair of hooks 226 located on the top left side plate 102 and the top right side plate 106, respectively. When the locking mechanism is not in use, the T-shaped members 208 may be swivelled forward, and the free ends of the chains 224 may be attached to the hooks 226.

Referring now again to FIGS. 1 through 5, additional elements are added to the dumpster bin 40 on the top of the top front frame member 46 and the top rear frame member 48. A ridge cap 228 is welded on top of the top front frame member 46 adjacent the rear edge thereof, and a ridge cap 230 is welded on top of the top rear frame member 48 adjacent the front edge thereof. The ridge caps 228 and 230 are made of sheet stock, and extend nearly (but not quite) the width of the dumpster bin 40.

The ridge caps 228 and 230 are highest in the centers thereof, and taper down to the height of the top front frame member 46 and the top rear frame member 48 at the ends thereof. Note that the taper is linear, but steeper for short portions adjacent the ends of the ridge caps 228 and 230. The top cover doors will rest on top of the ridge caps 228 and 230.

Referring now specifically to FIG. 15, a pulley assembly 232 is illustrated which has a pulley 234 rotatably mounted therein. As best shown in FIG. 3, the pulley assembly 232 is mounted on the front side of the dumpster bin 40 on the top front frame member 46.

Figure 16:
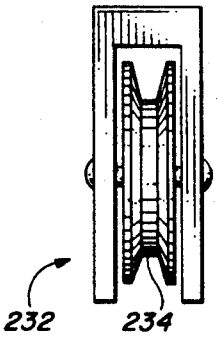
FIG. 16 is a side view of the pulley assembly shown in FIG. 3, showing the pulley contained therein.
Figure 17:
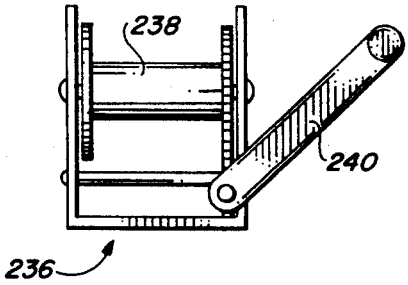
Fig. 17 is an enlarged view of the hand crank winch shown in FIG. 3.

Referring now to Fig. 16, a hand crank winch 236 is illustrated which has a cable take-up reel 238 for winding a cable (not shown in FIG. 16) thereon. A hand crank 240 is turned to pull the cable into the hand crank winch 236, where it is wound onto the cable take-up reel 238. As best shown in FIG. 3, the hand crank winch 236 is mounted onto the top front side plate 110 and the bottom front side plate 112.

Figure 19:
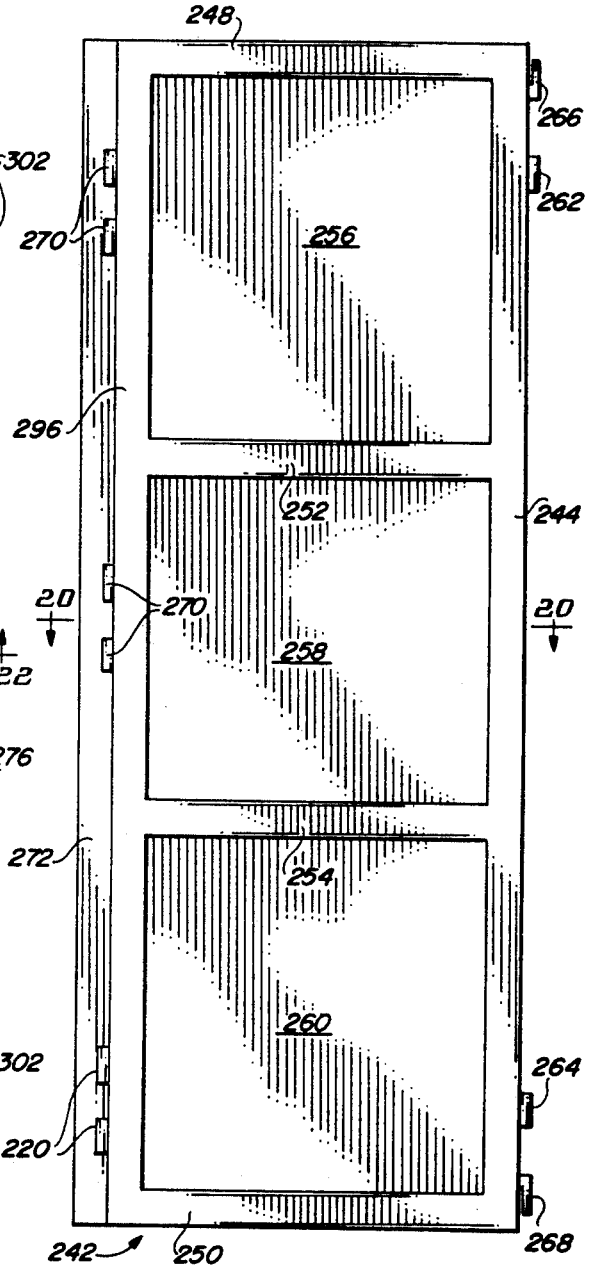
FIG. 19 is a plan view from the bottom side of a first top cover door, showing the locations of a plurality of hinge tubes on both sides thereof, a pair of rollers located on the outside edge of the first top cover door, and an angled ridge cover extending from the inside edge of the top of the first top cover door.

Referring next to FIGS. 19 and 20, a first top cover door 242 is illustrated. The first top cover door 242 has a frame made of six frame members, including a left side frame member 244, a right side frame member 246, a front side frame member 248, and a rear side frame member 250. Two additional frame members 252 and 254 extend between the left side frame member 244 and the right side frame member 246 and are evenly and consecutively spaced at locations between the front side frame member 248 and the rear side frame member 250.

Three cover plates 256, 258, and 260 are welded on top of the frame. The cover plate 256 is mounted on and extends between the left side frame member 244, the right side frame member 246, the front side frame member 248, and the frame member 252. The cover plate 258 is mounted on and extends between the left side frame member 244, the right side frame member 246, and the frame members 252 and 254. The cover plate 260 is mounted on and extends between the left side frame member 244, the right side frame member 246, the frame member 254, and the rear side frame member 250.

Figure 5:
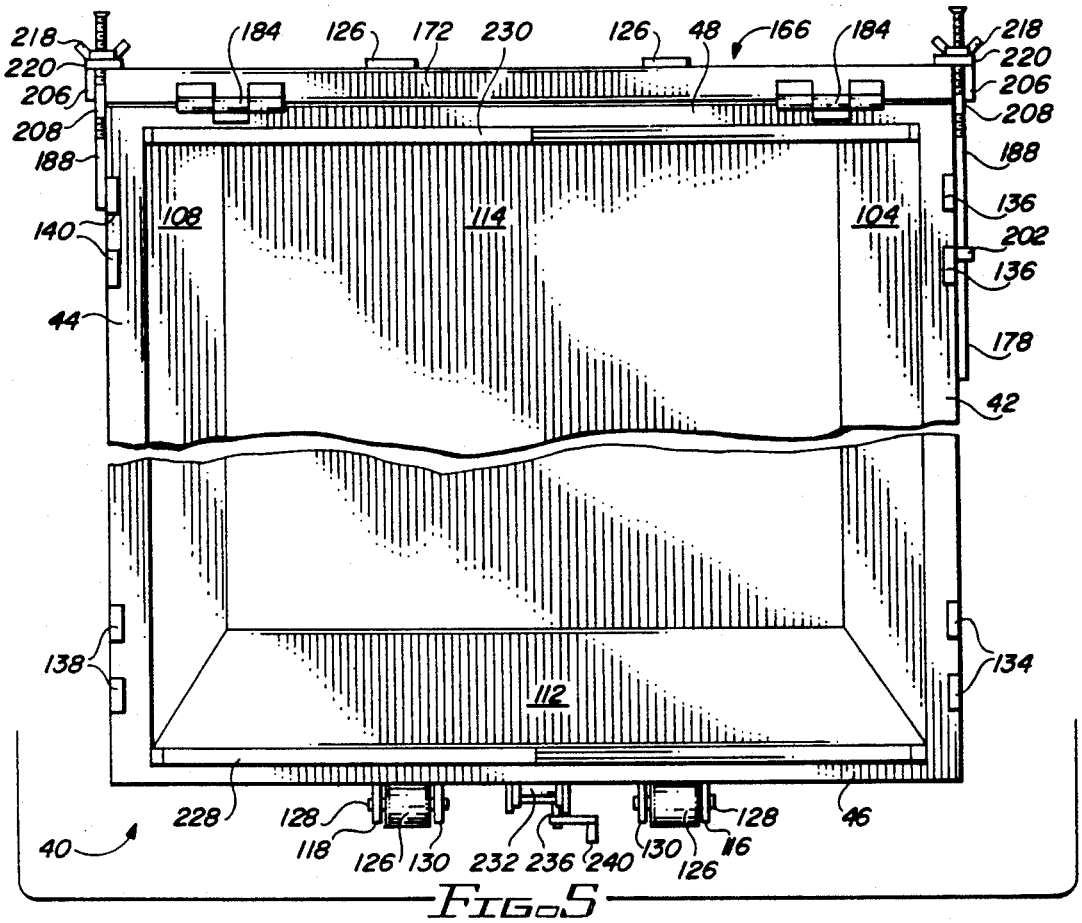
FIG. 5 is a top view of the dumpster bin shown in Figs. 1 through 4, showing the locations of the two pairs of hinge tubes on top of each side of the dumpster bin.

Located on the outer side of the left side frame member 244 are two hinge tubes 262 and 264. The hinge tube 262 is located near the front end of the first top cover door 242, and is designed for interdigitated engagement with the pair of hinge tubes 134 near the front of the top left frame member 42 (FIG. 5.) The hinge tube 264 is located near the rear end of the first top cover door 242, and is designed for interdigitated engagement with the pair of hinge tubes 136 near the rear of the top left frame member 42.

Also located on the outer side of the left side frame member 244 are two rollers 266 and 268. The roller 266 is located near the front end of the first top cover door 242, and is designed for engagement with the ridge cap 228 near the front of the dumpster bin 40 (FIG. 5). The roller 268 is located near the rear end of the first top cover door 242, and is designed for engagement with the ridge cap 230 near the rear of the dumpster bin 40.

Located on the outer side of the right side frame member 246 are three pair of hinge members collectively referred to as 270. The hinge members 270 will be used to hingedly connect the first top cover door 242 to a second top cover door. Located on the top side of the first top cover door 242 and extending over the edge of the right side frame member 246 is an angled ridge cover 272, which will cover the are between the first top cover door 242 and the second top cover door. The angled ridge cover 272 extends the length of the first top cover door 242.

Figure 21:
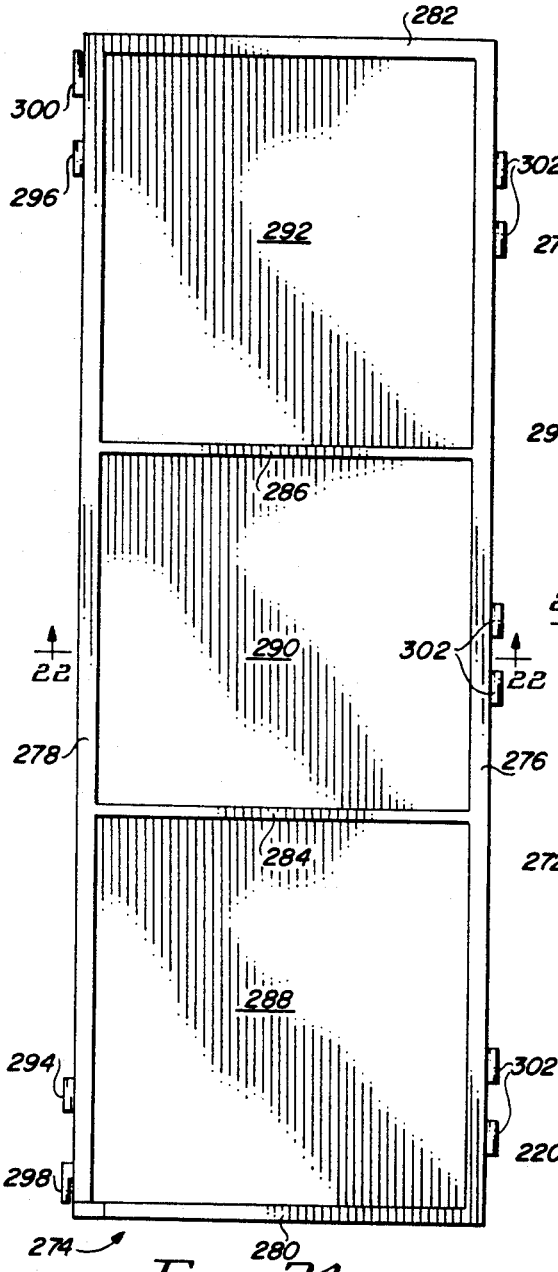
FIG. 21 is a plan view from the top side of a second top cover door, showing the locations of a plurality of hinge tubes on both sides thereof, and a pair of rollers located on the outside edge of the second top cover door.
Figure 22:
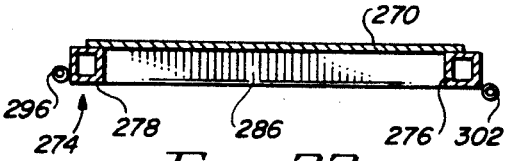
FIG. 22 is a cross-sectional view of the second cover door shown in FIG. 21.

Referring now to FIGS. 21 and 22, a second top cover door 274 is illustrated. The second top cover door 274 has a frame made of six frame members, including a left side frame member 276, a right side frame member 278, a front side frame member 280, and a rear side frame member 282. Two additional frame members 284 and 286 extend between the left side frame member 276 and the right side frame member 278 and are evenly and consecutively spaced at locations between the front side frame member 280 and the rear side frame member 282.

Three cover plates 288, 290, and 292 are welded on top of the frame. The cover plate 288 is mounted on and extends between the left side frame member 276, the right side frame member 278, the front side frame member 280, and the frame member 284. The cover plate 290 is mounted on and extends between the left side frame member 276, the right side frame member 278, and the frame members 284 and 286. The cover plate 292 is mounted on and extends between the left side frame member 276, the right side frame member 278, the frame member 286, and the rear side frame member 282.

Located on the outer side of the right side frame member 278 are two hinge tubes 294 and 296. The hinge tube 294 is located near the front end of the second top cover door 274, and is designed for interdigitated engagement with the pair of hinge tubes 138 near the front of the top right frame member 44 (FIG. 5.) The hinge tube 296 is located near the rear end of the second top cover door 274, and is designed for interdigitated engagement with the pair of hinge tubes 140 near the rear of the top right frame member 44.

Also located on the outer side of the right side frame member 246 are two rollers 298 and 300. The roller 298 is located near the front end of the second top cover door 274, and is designed for engagement with the ridge cap 228 near the front of the dumpster bin 40 (FIG. 5). The roller 300 is located near the rear end of the second top cover door 274, and is designed for engagement with the ridge cap 230 near the rear of the dumpster bin 40.

Located on the outer side of the left side frame member 276 are three pair of hinge members collectively referred to as 302. The hinge members 302 are used to hingedly connect the second top cover door 274 to the hinge members 270 on the first top cover door 242 (with hinge pins which are not shown herein). Thus, the top cover doors 242 and 274 are hingedly attached. When they are in their closed position on top of the dumpster bin 40, it will be noted that the angled ridge cover 272 overlies the area between the top cover doors 242 and 274, as shown in FIG. 23.

For the purposes of an example, it will be assumed that the first top cover door 242 will be hingedly attached to the left side of the dumpster bin 40. Thus, the hinge tube 262 of the first top cover door 242 will be retained in the pair of hinge tubes 134 on the front of the top left frame member 42 by the hinge pin 142. Similarly, the hinge tube 264 of the first top cover door 242 will be retained in the pair of hinge tubes 136 on the rear of the top left frame member 42 by the hinge pin 146. This position is shown in FIGS. 23 through 25, and in FIG. 29.

In this position, to lock the top cover doors 242 and 274 in position on top of the dumpster bin 40, the hinge pin 150 will be inserted to lock the hinge tube 294 to the pair of hinge tubes 138, and the hinge pin 154 will be inserted to lock the hinge tube 296 to the pair of hinge tubes 140. In the example discussed with regard to FIGS. 23 through 25, and in FIG. 29, it will be assumed that the hinge pins 150 and 154 are not installed.

Figure 23:
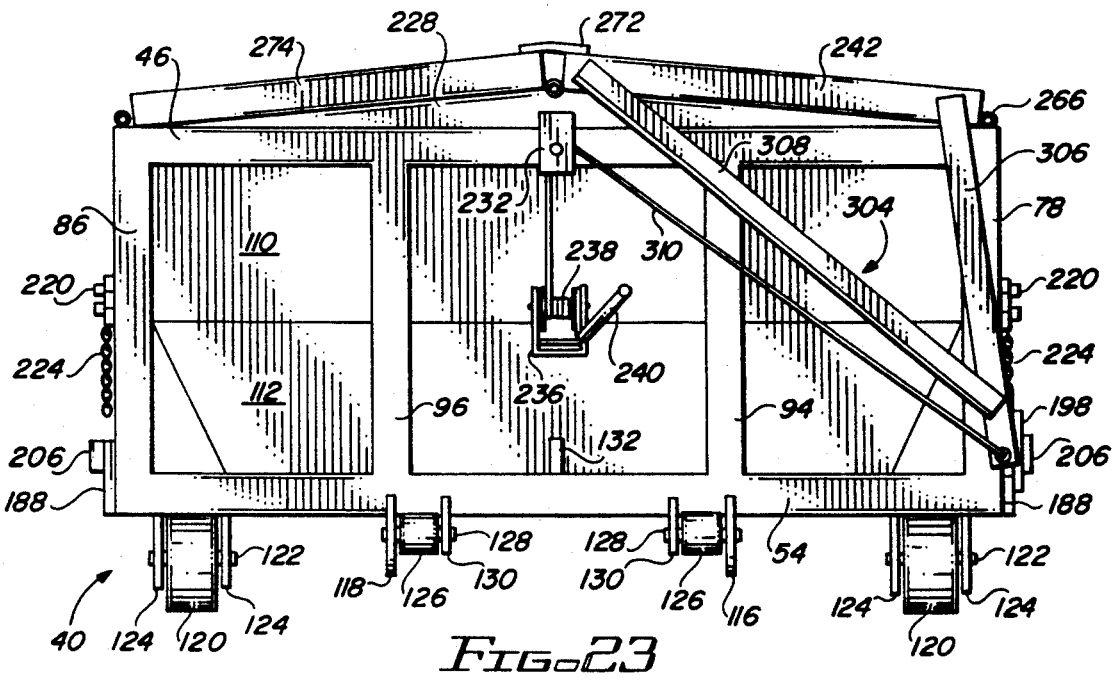
FIG. 23 is a front side view of the dumpster bin shown in Figs. 1 through 6 with the top cover doors installed on the dumpster bin and a pivot arm assembly installed on the second top cover door, with the hand cranked winch and a pulley assembly used to operate a cable connected to the pivot arm assembly, and with the mechanism shown in a position in which the top cover doors are in their closed position.
Figure 24:
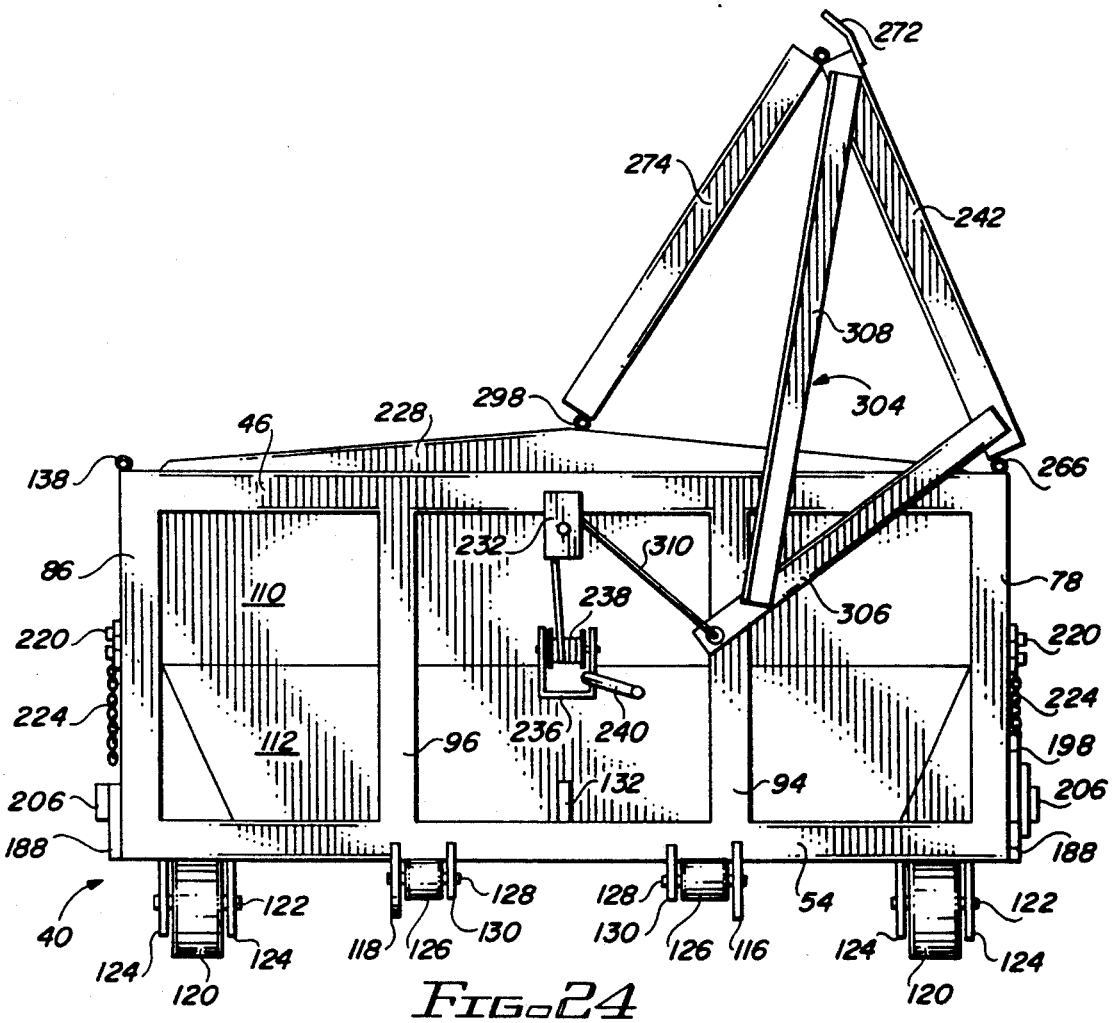
FIG. 24 is a front side view of the dumpster bin shown in FIG. 23, with the mechanism shown in a position in which the top cover doors are in an intermediate, partially opened position.

In FIG. 23, a pivot arm assembly 304 is illustrated which includes two arms 306 and 308. The arm 306 has a first end which is attached to the front of the first top cover door 242 near the left side thereof. The second end of the arm 306 extends downward and slightly toward the left side of the dumpster bin 40. The arm 308 has a first end which is attached to the front of the first top cover door 242 near the right side thereof. The second end of the arm 308 is attached to the arm 306 at a location near the second end of the arm 306.

The first top cover door 242, the arm 306, and the arm 308 together form a triangular form which may not collapse. A cable 310 is attached at one end to the cable take-up reel 238 of the hand crank winch 236. The other end of the cable 310 is fed over the pulley 234 in the pulley assembly 232, and attached to the second end of the arm 306. To open the top cover doors 242 and 274, the hand crank 240 of the hand crank winch 236 is turned to wind the cable 310 onto the cable take-up reel 238.

As the cable 310 is progressively wound onto the cable take-up reel 238, the top cover doors 242 and 274 move from the closed position shown in FIG. 23, to the partially open position shown in FIG. 24, to the fully open position shown in FIG. 25. Thus, it will be appreciated that only a single person is required to open the top cover doors 242 and 274 using the mechanism of the present invention. Closing the top cover doors 242 and 274 merely requires that the cable 310 be paid out from the cable take-up reel 238.

Referring next to FIG. 26, a pivot arm assembly 312 is illustrated mounted onto the second top cover door 274. The pivot arm assembly 312 includes two arms 314 and 316. The arm 314 has a first end which is attached to the front of the second top cover door 274 near the right side thereof. The second end of the arm 314 extends downward and slightly toward the right side of the dumpster bin 40. The arm 316 has a first end which is attached to the front of the second top cover door 274 near the left side thereof. The second end of the arm 316 is attached to the arm 314 at a location near the second end of the arm 314. The cable 310 would be attached to the second end of the arm 314.

To use the pivot arm assembly 312, the second top cover door 274 will be hingedly attached to the right side of the dumpster bin 40. Thus, the hinge tube 294 of the second top cover door 274 will be retained in the pair of hinge tubes 138 on the front of the top right frame member 44 by the hinge pin 150. Similarly, the hinge tube 296 of the second top cover door 274 will be retained in the pair of hinge tubes 140 on the rear of the top right frame member 44 by the hinge pin 154.

In this position, to lock the top cover doors 242 and 274 in position on top of the dumpster bin 40, the hinge pin 142 will be inserted to lock the hinge tube 262 to the pair of hinge tubes 134, and the hinge pin 146 will be inserted to lock the hinge tube 264 to the pair of hinge tubes 136. To use the pivot arm assembly 312 shown in FIG. 26, the hinge pins 150 and 154 would not be installed.

An alternate embodiment of the present invention may be used to allow either of the top cover doors 242 and 274 to be used as the hingedly mounted door. A bracket 318 is illustrated in FIG. 27 which has an aperture 320 therethrough. The bracket 318 will be mounted on top of each of the top cover doors 242 and 274 at the front thereof, at the left side of the first top cover door 242 and at the right side of the second top cover door 274. One of the brackets 318 is visible in its mounted position in FIG. 29.

Referring now to FIG. 28, a dual pivot arm assembly 322 is illustrated which is essentially a combination of the pivot arm assemblies 304 and 312. The dual pivot arm assembly 322 has a first left arm 324 similar to the arm 306 of the pivot arm assembly 304, and a second left arm 326 similar to the arm 308 of the pivot arm assembly 304. The dual pivot arm assembly 322 also has a first right arm 328 similar to the arm 314 of the pivot arm assembly 312, and a second right arm 330 similar to the arm 316 of the pivot arm assembly 312.

The second end of the second left arm 326 is connected to the first left arm 324 at a location near the second end of the first left arm 324. The second end of the second right arm 330 is connected to the first right arm 328 at a location near the second end of the first right arm 328. The cable 310 may be connected either at the second end of the first left arm 324, or at the second end of the first right arm 328.

Figure 29:
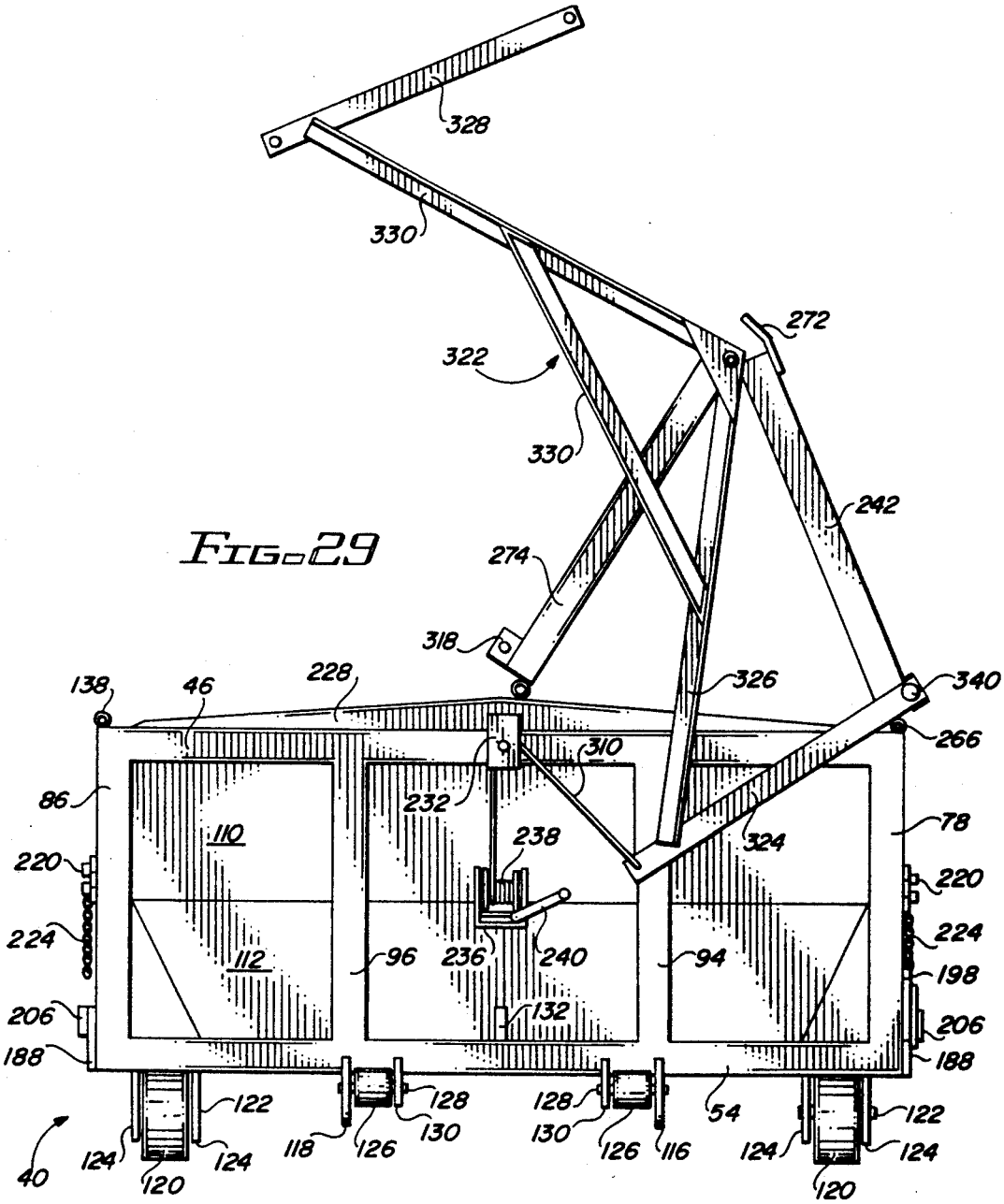
FIG. 29 is a front side view of the dumpster bin shown in Figs. 1 through 6 with the top cover doors installed on the dumpster bin, the brackets shown in FIG. 27 installed on the first and second top cover doors, and the alternate embodiment dual pivot arm assembly shown in FIG. 28 installed to operate the first top cover door, with the hand cranked winch and a pulley assembly used to operate a cable connected to the dual pivot arm assembly, and with the mechanism shown in a position in which the top cover doors are in their closed position.

The dual pivot arm assembly 322 has the first ends of the second left arm 326 and the second right arm 330 connected together, and uses a brace 332 between the second left arm 326 and the second right arm 330. An aperture 334 is located at the first ends of the second left arm 326 and the second right arm 330. This aperture will be connected to a hinge pin (not shown) extending through the hinge members 270 of the first top cover door 242 and the hinge members 302 of the second top cover door 274, as shown in FIG. 29.

A aperture 336 is located at the first end of the first left arm 324, and an aperture 338 is located at the first end of the first right ar 328. A pin 340 will be connected in the aperture 336 in the first left arm 324 to the aperture 320 in the bracket 318 located at the left side of the first top cover door 242 if the first top cover door 242 is to be hinged to the dumpster bin 40. In this case, the cable 310 will be connected to the second end of the first right arm 328.

Alternately, if the second top cover door 274 is to be hinged to the dumpster bin 40, the pin 340 will be connected in the aperture 338 in the first right arm 328 to the aperture 320 in the bracket 318 located at the right side of the second top cover door 274. In this case, the cable 310 will be connected to the second end of the first left arm 324. Thus, with the dual pivot arm assembly 322 either of the top cover doors 242 or 274 may be hinged to the dumpster bin 40. This means that the top cover doors 242 and 274 may be opened either to the left side of the dumpster bin 40 or to the right side of the dumpster bin 40.

It may therefore be appreciated from the above detailed description of the preferred embodiment of the present invention that it teaches a highly secure, yet easily operated dumpster bin top cover apparatus which allows the entire top of the dumpster bin to be opened. The operation of the mechanism to open or close the doors of a dumpster bin is quick and convenient, and may be easily performed by a single individual. Further, opening the top of a dumpster bin does not require that a dumpster bin located with its side against the side of a building be moved prior to opening the top of the dumpster bin.

The double top cover door design of the present invention possesses all of the advantages listed above, and is eminently suitable for use with larger dumpster bins. The top cover doors of the present invention include a securing mechanism which maintains refuse in the dumpster bin, both during storage and during transport to a refuse disposal site. The securing means requires only the insertion of a pair of pins, and is thus easy and quick to perform, and of course may be accomplished by a single individual. A water resistant design is utilized in the top cover doors of the dumpster bin. The top cover mechanism of the present invention allows the use of a rear side door through which the contents of the dumpster bin may be removed, if desired.

The dumpster bin top cover doors and operating mechanism which embody the preceding principles of the present invention are of a construction not significantly more expensive than steel top cover doors of previously available dumpster bins. In addition, the dumpster bin top cover doors of the present invention are every bit as durable and long lasting as the top cover doors of such presently available dumpster bins. It should be understood that the materials used in construction of the doors could readily be plastic or other materials, the use of different materials which would not depart from the sense or scope of the invention. Finally, all of the aforesaid advantages and objectives of the present invention are achieved without incurring any substantial relative disadvantage.

Although an exemplary embodiment of the present invention has been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. A closure apparatus for removably closing an opening in the top of a refuse container or the like, comprising:

a first top cover door having a first side and a second side opposite said first side thereof;

a second top cover door having a first side and a second side opposite said first side thereof, said first side of said second top cover door being hingedly mounted to said first side of said first top cover door, said first and second top cover doors being capable of pivoting movement relative to each other;

means for hingedly mounting said second side of said first top cover door to the top of said refuse container at a first side of said opening in the top of said refuse container;

means for selectively driving said first top cover door between a first position in which said first top cover door and said second top cover door together cover said opening in the top of said refuse container, and a second position in which said first top cover door is pivoted away from said opening in the top of said refuse container and in which said second top cover door is folded substantially against said first top cover door, a pivot arm mounted on a third side of said first top cover door extending between said first and second sides of said first top cover door, means for driving said pivot arm, a first arm having a first end and a second end, said first end of said first arm being mounted onto a third side of said first top cover door extending between said first and second sides of said first top cover door at a location close adjacent said first side of said first top cover door; and a second arm having a first end and a second end, said first end of said second arm being mounted onto said third side of said first top cover door at a location close adjacent said second side of said first top cover door, said second ends of said first and second arms being connected together and being driven by said means for driving said pivot arm.

2. A closure apparatus as defined in claim 1, wherein said first and second arms are in a plane essentially orthogonal to said first top cover door.

3. A closure apparatus for removably closing an opening in the top of a refuse container or the like, comprising:

a first top cover door having a first side and a second side opposite said first side thereof;

a second top cover door having a first side and a second side opposite said first side thereof, said first side of said second top cover door being hingedly mounted to said first side of said first top cover door, said first and second top cover doors being capable of pivoting movement relative to each other;

means for hingedly mounting said second side of said first top cover door to the top of said refuse container at a first side of said opening in the top of said refuse container;

means for selectively driving said first top cover door between a first position in which said first top cover door and said second top cover door together cover said opening in the top of said refuse container, and a second position in which said first top cover door is pivoted away form said opening in the top of said refuse container and in which said second top cover door is folded substantially against said first top cover door, and a pair of ridge caps located on said top of said refuse container on opposite sides thereof, said ridge caps being higher in the middle thereof than on the ends thereof, said first top cover door being located on both ridge caps on one side of the middles thereof when said first top cover door is in said first position, said second top cover door being located on both ridge caps on the other side of the middles thereof when said first top cover door is in said first position.

4. A closure apparatus as defined in claim 3, additionally comprising:

means, mounted on one of said first or second top cover doors, for covering the area between said first and second cover doors when said first top cover door is in said first position.

* * * * *